US005671791A

United States Patent [19]

Lapointe

[11] Patent Number: 5,671,791

[45] Date of Patent: Sep. 30, 1997

[54] AWNING TENSIONING STRUCTURE

[76] Inventor: Serge Lapointe, 221 des Pins, St. Amable, Quebec, Canada, J0L 1N0

[21] Appl. No.: 538,395

[22] Filed: Oct. 3, 1995

[30] Foreign Application Priority Data

Aug. 14, 1995 [CA] Canada ..... 2156033

[51] Int. Cl.[6] ..... E04F 10/00

[52] U.S. Cl. ..... 160/46; 160/83.1; 160/378

[58] Field of Search ..... 160/45, 46, 47, 160/83.1, 375, 378; 135/88.1

[56] References Cited

U.S. PATENT DOCUMENTS

| | | | |
|---|---|---|---|
| 2,218,451 | 10/1940 | Heyne | 160/378 X |
| 2,423,402 | 7/1947 | Olsen | 160/378 X |
| 3,485,165 | 12/1969 | Hughes | 160/378 X |
| 4,192,112 | 3/1980 | Reilly, Sr. | 160/46 X |
| 4,692,847 | 9/1987 | Gandy | 160/378 X |
| 4,697,326 | 10/1987 | Faircloth | 160/378 X |
| 5,046,545 | 9/1991 | Loomis et al. | 160/378 X |

*Primary Examiner*—Blair Johnson
*Attorney, Agent, or Firm*—Eric Fincham

[57] ABSTRACT

There is provided a tensioning arrangement for an awning structure which includes a plurality of vertical support posts and at least one horizontal member extending between a pair of the posts and having an awning of a flexible sheet material secured at one end and having a free marginal edge at an opposed end thereof, the tensioning member being mounted in a moveable relationship to the horizontal member, the tensioning member having means for receiving the free marginal edge and means for removing the tensioning member with respect to the horizontal member to thereby apply tension to the flexible sheet material. Operation of the system permits one to quickly achieve a uniform tension and maintain the same.

6 Claims, 2 Drawing Sheets

AWNING TENSIONING STRUCTURE

BACKGROUND OF THE INVENTION

The present invention relates to awning structures and more particularly, relates to a tensioning arrangement for awning structures.

The use of awnings in connection with residential and commercial structures is well known. These awnings are used to provide protection against the elements of weather including rain, wind, sun, etc. Generally, the awnings may either be of the fixed type or moveable.

Of the fixed type awnings, one approach has been to use rigid materials wherein the awning is usually left in place for the four seasons or else the whole structure is removed. A second approach has been to use a flexible sheet like material for the awning and which material is placed over a suitable support structure which usually includes vertical posts about the perimeter with horizontal members extending therebetween. The flexible sheet material is secured adjacent the wall of the building from which it extends or alternatively from some other appropriate horizontal support. In turn, the material extends over the top of the area to be protected, generally at an incline to permit the shedding of any precipitation.

Traditionally, awnings formed using a flexible sheet material are what is often referred to as of the three season variety—they are disassembled in winter since they usually cannot support the weight of snow and furthermore the enclosed areas generally receives little use during the winter months. As such, the awnings must be reinstalled every year.

The proper installation of the awning requires that the awning be tensioned. Traditionally, this has been accomplished by means of a plurality of strings extending through eyelets in the awning and which are then wrapped around a horizontal member. Proper tensioning is not always achieved since it is possible that a uniform pressure is not exerted on the awning.

SUMMARY OF THE INVENTION

It is an object of the present invention to provide a tensioning system for awnings which is simple and easy to use and helps speed up the tensioning process.

According to one aspect of the invention, there is provided an awning system which includes a plurality of vertical support posts, as least one horizontal member extending between a pair of the posts, and an awning of a flexible sheet material secured at one end thereof and having a free marginal edge at an opposed end thereof, and a tensioning member mounted in a moveable relationship to the horizontal member, the tensioning member having means for receiving the free marginal edge of the flexible sheet material, and means for moving the tensioning member with respect to the horizontal member to thereby apply tension to the flexible sheet material.

There is also provided an extrusion suitable for use in an awning system, the extrusion comprising a tubular member, a first attachment means formed integrally with the member, a tensioning assembly comprising an outwardly extending element from said member, said element terminating in a flange portion, said flange portion having means for receiving at least one screw threaded member.

In greater detail, the tensioning system of the present invention is adapted for use with patio type awning covers. Generally, these are a three season type of awning cover which are removed and reinstalled each year.

Such awning structures generally include a plurality of vertical support members (posts) and at least one horizontal member interconnecting the posts. In many structures, the horizontal member also serves as a frame element and conveniently, the practice of the present invention can be accomplished using a horizontal member which also functions as a part of the awning frame.

In a preferred embodiment, there is provided a tensioning member which is mounted in a moveable relationship with the frame element and in particular, is moveable away from and towards the frame element. The tensioning member includes means for receiving a free marginal edge of the flexible sheet member and such means may include any conventional. A preferred arrangement is a groove into which the edge of the awning is frictionally engaged.

The tensioning member adapted to receive the free marginal edge, as previously mentioned, is mounted so as to be moveable away from the frame element or horizontal member. There are also provided means for maintaining the tensioning member in a spaced relationship therefrom. Although different means can be employed, a convenient one is the use of screw threaded members screw threadedly engaged with a portion of the horizontal member and having a free end adapted to engage the tensioning member to move it in a desired direction. Alternatively, a reverse arrangement could be employed wherein the screw threaded member is engaged with the tensioning member and moveable so as to engage the horizontal element.

As will be appreciated, the components of the present invention can be formed of various materials including plastic and metallic materials. In a preferred embodiment, the various members of the arrangement can be extrusions of a suitable plastic or metallic material.

Having thus generally described the invention, reference will be made to the accompanying drawings illustrating an embodiment thereof, in which:

BRIEF DESCRIPTION OF THE DRAWINGS

FIG. 3 is a sectional view taken along the lines 3—3 of FIG. 4;

DESCRIPTION OF THE PREFERRED EMBODIMENTS

Figure 1:
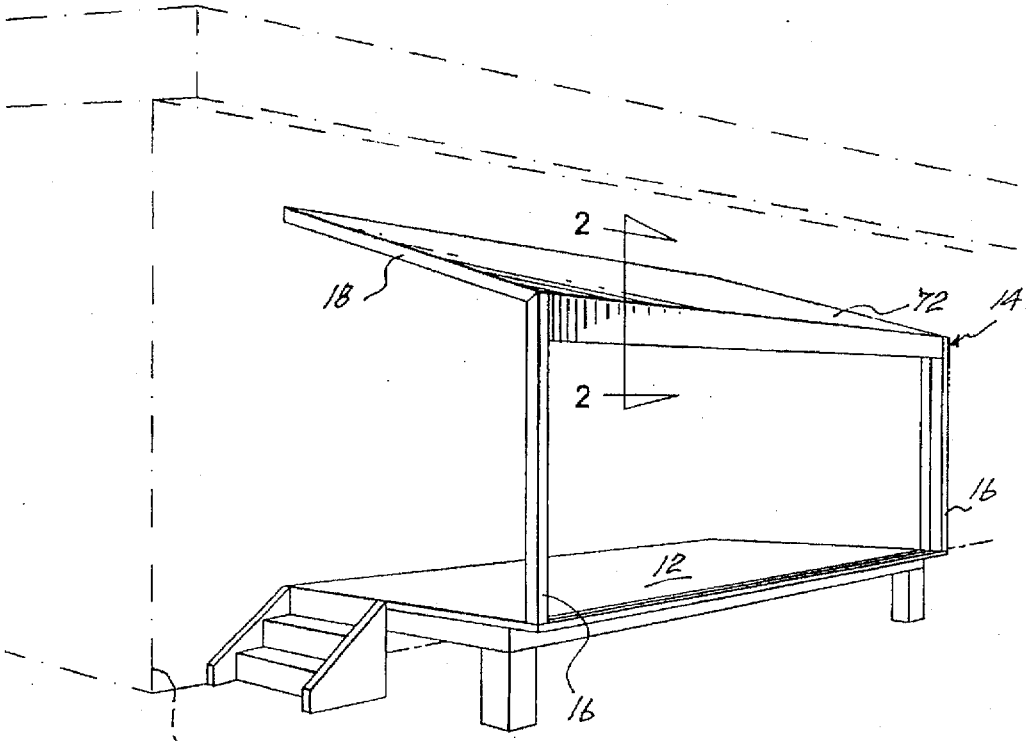
FIG. 1 is a perspective view of an awning arrangement.

Referring to the drawings in greater detail and by reference characters thereto, there is illustrated in FIG. 1 a building structure 10 which is outlined in dotted lines. A deck or patio 12 extends therefrom and there is provided an awning system which is generally designated by reference numeral 14.

Awning system 14 includes a plurality of vertical supports 16 (only two shown) along with rafters 18 and having a horizontal frame member 20 extending between vertical supports 16.

Horizontal frame member 20 is preferably a tubular extrusion and in the illustrated embodiment, has a top face or wall 22, a bottom wall 24, a front wall 26 and a rear wall 28.

Extending downwardly from bottom wall 24 is a downwardly extending portion 30 to which is attached a C-shaped attachment 32. C-shaped attachment 32 is adapted to receive and support a screen 34 or the like. The screen or other member can include a suitable spline 61 to fit within element 32.

Also extending downwardly from bottom wall 24 of frame member 20 are a plurality of pieces 36, each of which terminate in a horizontal flange 38.

Figure 2:
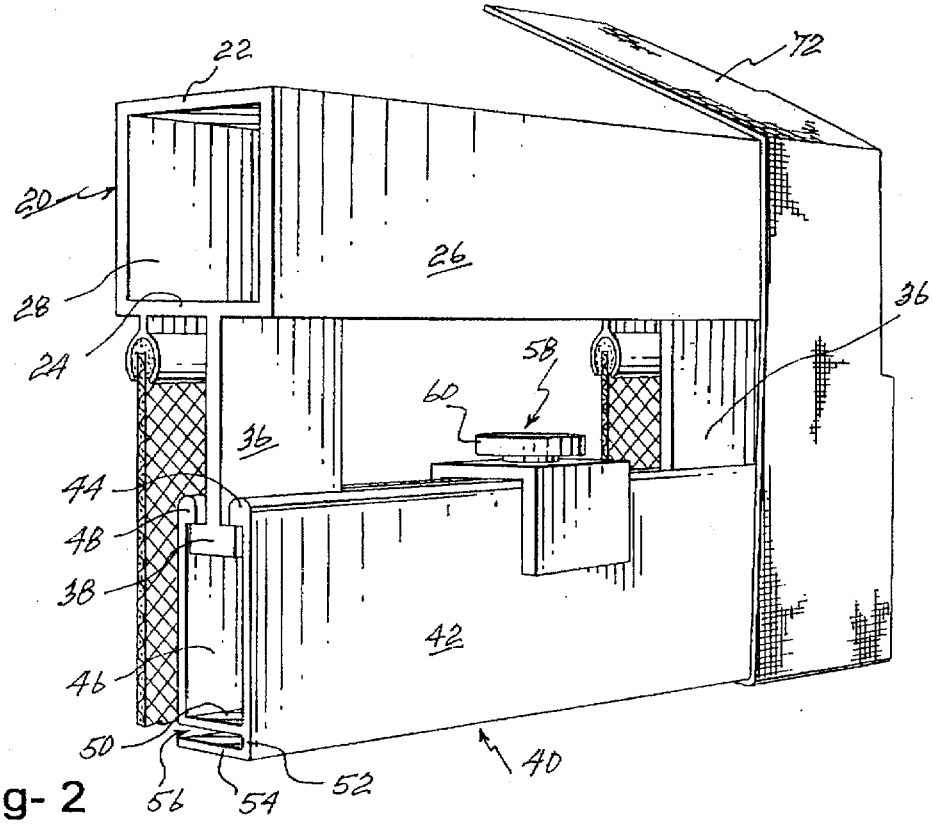
FIG. 2 is a detailed view of the upper portion of the awning structure.

The tensioning member generally designated by reference numeral 40 includes first and second parallel side walls 42 and 46. Side wall 42 terminates, at one end thereof, in an inwardly extending flange 44 while side wall 46 also terminates in a similar inwardly extending flange 48. Flanges 44 and 48 are adapted to rest on flange 38 of pieces 36 as may be seen in FIGS. 2, 3 and 5.

At the other end of side walls 42 and 46, there is provided a bottom wall 50 which extends between side walls 42 and 46. Side wall 42 continues downwardly to form a side wall extension 52 which terminates in a further wall 54 parallel to and spaced from bottom wall 50 to thereby define a channel 56 therebetween.

There are provided a plurality of adjustment screws generally designated by reference numeral 58 and which adjustment screws are screw threadedly engaged with flange 38 between downwardly extending pieces 36. Each adjustment screw 58 has a head portion 60 and a shaft 62. There is also provided a U-shaped reinforcing element 64 which has a pair of side walls 66 and 68 adapted to lie in co-planar relationship and adjacent to side walls 42 and 46 respectively. A top wall 70 extends between side walls 66 and 68.

A canopy or awning 72 formed of a flexible sheet material has a free marginal folded edge with a reinforcing strip 74 being placed therein.

Figure 5:
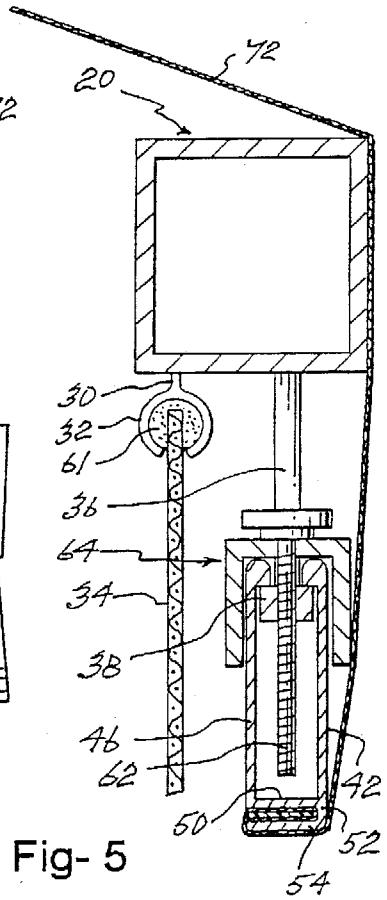
FIG. 5 is a sectional view taken along the lines 5—5 of FIG. 4.
Figure 4:
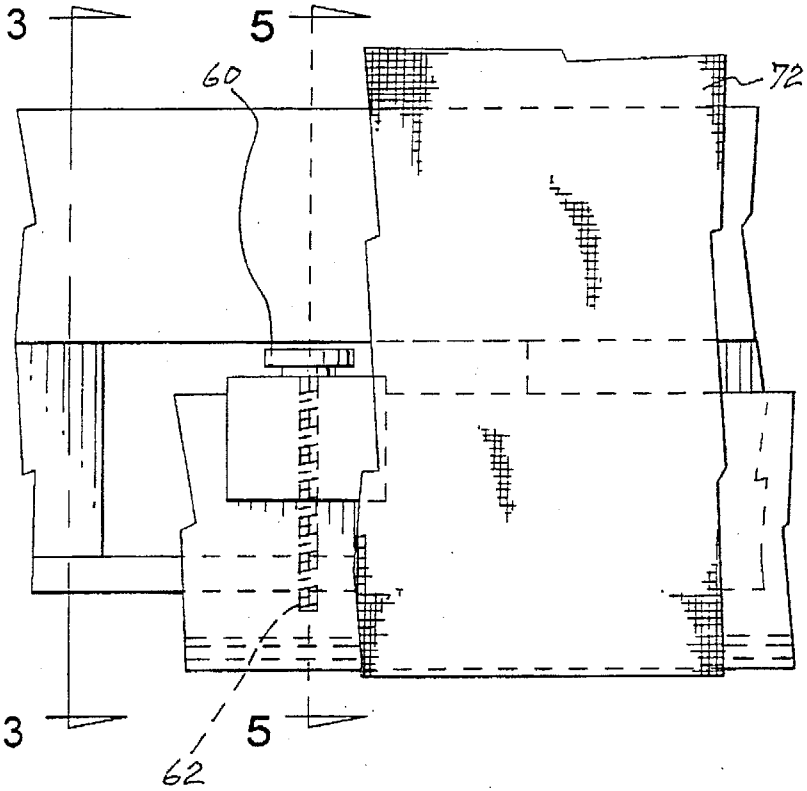
FIG. 4 is a side elevational view, partially in cutaway and section, illustrating an untensioned awning on the left hand side and a tensioned awning on the right hand side thereof.
Figure 3:
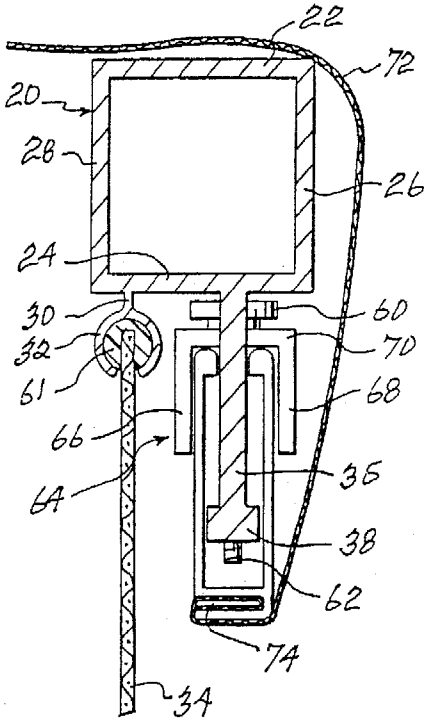
FIG. 3 is a view along the lines 2—2 of FIG. 1.

In operation, and as shown in FIG. 3, the free marginal edge of canopy or awning 72 is inserted in channel 56. Subsequently, adjustment screws 58 are turned whereby the position of tensioning member 40 from bottom wall 24 is controlled to thereby tension the device. Each of the adjustment screws 58 may be individually and quickly adjusted to thereby properly tension awning 72 as shown in FIG. 5.

It will be understood that the above described embodiment is for purposes of illustration only and that changes and modifications may be made thereto without departing from the spirit and scope of the invention.

I claim:

1. An awning system including a plurality of vertical support posts, at least one horizontal member extending between a pair of the support posts, an awning of a flexible sheet material secured at one end thereof and having a free marginal edge at an opposed end thereof, and a tensioning assembly, said horizontal member having a of flange segment extending downwardly therefrom, each of said flange segments having a plurality of vertical portions and a horizontal portion at a distal end of said vertical portions, said tensioning assembly comprising a tensioning member having a pair of side walls, an upper wall and a bottom wall, said tensioning member having an internal cavity, a slot in said upper wall communicating with said internal cavity, said tensioning member being mounted on said flange segments such that said tensioning member is vertically moveable thereon while being retained by said horizontal flange segments, said bottom wall having a channel formed therein to receive said free marginal edge of said sheet material, said channel opening towards the area covered by said awning, and a plurality of adjustment screws, each adjustment screw being threadedly engaged with said flange segments, each adjustment screw being located intermediate said horizontal portions of said flange segments, the arrangement being such that when said free marginal edge of said flexible sheet material is inserted in said channel in said bottom wall of said tensioning member, said sheet material covers said bottom wall and the portions of said tensioning member opposite said area covered by said awning and said horizontal member.

2. The awning system of claim 1 wherein each of said adjustment screws comprises a shaft and a head thereon, said adjustment screws located such that said head abuts said horizontal member to thereby limit vertical movement of said tensioning member.

3. The awning system of claim 2 wherein said horizontal member comprises a structural frame member extending between said support posts.

4. The awning system of claim 1 further including attachment means on said horizontal member for receiving a wall component.

5. The awning system of claim 4 wherein said attachment means comprises a downwardly extending C-shaped flange.

6. The awning system of claim 2 further including a U-shaped reinforcing element associated with each of said adjustment screws, each of said U-shaped reinforcing elements having a top wall and a pair of downwardly depending side walls, said reinforcing elements being located such that said adjustment screw passes through said top wall which lies in coplanar relationship with said upper wall of said tensioning member and said downwardly depending side walls lie in coplanar relationship with said side walls of said tensioning member.

* * * * *